US006326111B1

(12) United States Patent
Chambers et al.

(10) Patent No.: US 6,326,111 B1
(45) Date of Patent: Dec. 4, 2001

(54) STABLE CHARGE TRANSPORT LAYER DISPERSION CONTAINING POLYTETRAFLUOROETHYLENE PARTICLES AND HYDROPHOBIC SILICA

(75) Inventors: John S. Chambers, Rochester; Huoy-Jen Yuh, Pittsford; Michael Sanchez, Fairport; Harold F. Hammond, Webster; Helen R. Cherniack, Rochester; Robert C. U. Yu; John S. Facci, both of Webster; Rachael McGrath, Churchville, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/712,184

(22) Filed: Nov. 15, 2000

(51) Int. Cl.[7] ..... G03G 5/05
(52) U.S. Cl. ..... 430/58.05; 430/59.6; 399/176
(58) Field of Search ..... 430/58.05, 66, 430/60, 59.6; 399/176

(56) References Cited

U.S. PATENT DOCUMENTS

| | | | |
|---|---|---|---|
| 3,121,006 | | 2/1964 | Middleton et al. . |
| 4,233,384 | | 11/1980 | Turner et al. . |
| 4,265,990 | | 5/1981 | Stolka et al. . |
| 4,299,897 | | 11/1981 | Stolka et al. . |
| 4,306,008 | | 12/1981 | Pai et al. . |
| 4,346,158 | | 8/1982 | Pai et al. . |
| 4,439,507 | | 3/1984 | Pan et al. . |
| 4,464,450 | | 8/1984 | Teuscher . |
| 4,654,284 | | 3/1987 | Yu et al. . |
| 5,096,795 | | 3/1992 | Yu . |
| 5,571,647 | | 11/1996 | Mishra et al. . |
| 5,571,648 | | 11/1996 | Mishra et al. . |
| 5,571,649 | | 11/1996 | Mishra et al. . |
| 5,576,130 | | 11/1996 | Yu et al. . |
| 5,591,554 | | 1/1997 | Mishra et al. . |
| 5,613,173 | | 3/1997 | Kunzmann et al. . |
| 5,637,142 | | 6/1997 | Kubo et al. . |
| 5,643,702 | | 7/1997 | Yu . |
| 5,667,926 | * | 9/1997 | Maruyama et al. ..... 430/97 |
| 5,725,983 | | 3/1998 | Yu . |

* cited by examiner

*Primary Examiner*—John Goodrow
(74) *Attorney, Agent, or Firm*—Oliff & Berridge, PLC

(57) ABSTRACT

A charge transport layer material for a photoreceptor includes at least a polycarbonate polymer, at least one charge transport material, polytetrafluoroethylene particle aggregates having an average size of less than about 1.5 microns, hydrophobic silica and a fluorine-containing polymeric surfactant dispersed in a solvent. The presence of the hydrophobic silica enables the dispersion to have superior stability by preventing settling of the PTFE particles. A resulting charge transport layer produced from the dispersion exhibits excellent wear resistance against contact with an AC bias charging roll, excellent electrical performance, and delivers superior print quality.

19 Claims, No Drawings

STABLE CHARGE TRANSPORT LAYER DISPERSION CONTAINING POLYTETRAFLUOROETHYLENE PARTICLES AND HYDROPHOBIC SILICA

BACKGROUND OF THE INVENTION

1. Field of the Invention

This invention relates to a stable charge transport layer composition of a photoreceptor used in electrophotography and a method of making the same. More in particular, the invention relates to a specific formulation for a charge transport layer containing both polytetrafluoroethylene (PTFE) particles and hydrophobic silica particles, the formulation forming a very stable dispersion for coating and achieving a charge transport layer imparting superior wear resistance to a photoreceptor and improved toner cleaning.

2. Description of Related Art

In the art of electrophotography, an electrophotographic plate comprising a photoconductive insulating layer on a conductive layer is imaged by first uniformly electrostatically charging the surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles, for example from a developer composition, on the surface of the photoconductive insulating layer. The resulting visible toner image can be transferred to a suitable receiving member such as paper.

Electrophotographic imaging members are usually multilayered photoreceptors that comprise a substrate support, an electrically conductive layer, an optional hole blocking layer, an optional adhesive layer, a charge generating layer, and a charge transport layer. The imaging members can take several forms, including flexible belts, rigid drums, etc. For most multilayered flexible photoreceptor belts, an anti-curl layer is usually employed on the back side of the substrate support, opposite to the side carrying the electrically active layers, to achieve the desired photoreceptor flatness. One type of multilayered photoreceptor comprises a layer of finely divided particles of a photoconductive inorganic compound dispersed in an electrically insulating organic resin binder.

U.S. Pat. No. 4,265,990 discloses a layered photoreceptor having a separate charge generating (photogenerating) layer (CGL) and charge transport layer (CTL). The charge generating layer is capable of photogenerating holes and injecting the photogenerated holes into the charge transport layer. The photogenerating layer utilized in multilayered photoreceptors include, for example, inorganic photoconductive particles or organic photoconductive particles dispersed in a film forming polymeric binder. Inorganic or organic photoconductive materials may be formed as a continuous, homogeneous photogenerating layer.

Examples of photosensitive members having at least two electrically operative layers including a charge generating layer and diamine containing transport layer are disclosed in U.S. Pat. Nos. 4,265,990, 4,233,384, 4,306,008, 4,299,897 and 4,439,507. The disclosures of these patents are incorporated herein in their entirety.

Charge transport layers are known to be comprised of any of several different types of polymer binders that have a charge transport material dispersed therein. However, these conventional charge transport layers suffer from a fast, nearly catastrophic wear rate of 8 to 10 microns or more per 100 kilocycles when the photoreceptor is charged using an AC bias charging roll (BCR). The use of AC bias charging rolls to charge a photoreceptor surface is conventional in the art for forming images in low speed, for example up to 40 ppm, imaging devices (e.g., copiers and printers). However, the corona generated from the AC current, applied to the BCR, decomposes on the top photoreceptor layer. The decomposed material can be easily removed by a cleaning blade. Such a repeated process during the printing cycle wears out the photoreceptor top layer very quickly.

Wear rate is a significant property in that it limits the life of the photoreceptor, and photoreceptor replacement in electrostatographic devices such as copiers and printers is very expensive. It is thus very significant to limit wear of the photoreceptor so as to achieve a long life photoreceptor, particularly with respect to small diameter organic photoreceptor drums typically used in low speed copiers and printers that are charged with an AC BCR. In such small diameter drums, 100 kilocycles translates into as few as 10,000 prints. CTL wear results in a considerable reduction in device sensitivity, which is a major problem in office copiers and printers that typically do not employ exposure control. In addition, the rapid wear of the top photoreceptor layer requires better cleaning of the debris from the photoreceptor surface in order to maintain good toner transfer and good copy quality.

U.S. Pat. No. 5,096,795, incorporated herein by reference in its entirety, describes an electrophotographic imaging member comprising a charge transport layer comprised of a thermoplastic film forming binder, aromatic amine charge transport molecules and a homogeneous dispersion of at least one of organic and inorganic particles having a particle diameter less than about 4.5 micrometers, the particles comprising a material selected from the group consisting of microcrystalline silica, ground glass, synthetic glass spheres, diamond, corundum, topaz, polytetrafluoroethylene, and waxy polyethylene, wherein said particles do not decrease the optical transmittancy or photoelectric functioning of the layer. The particles provide coefficient of surface contact friction reduction, increased wear resistance, durability against tensile cracking, and improved adhesion of the layers without adversely affecting the optical and electrical properties of the imaging member. Specific materials as in the present invention are not taught, nor is it taught to use the charge transport layer in an apparatus employing an AC bias charging roll.

U.S. Pat. No. 5,725,983, incorporated herein by reference in its entirety, describes an electrophotographic imaging member including a supporting substrate having an electrically conductive layer, a hole blocking layer, an optional adhesive layer, a charge generating layer, a charge transport layer, an anticurl back coating, a ground strip layer and an optional overcoating layer, at least one of the charge transport layer, anticurl back coating, ground strip layer and the overcoating layer comprising a blend of inorganic and organic particles homogeneously distributed in a film forming matrix in a weight ratio of between about 3:7 and about 7:3, the inorganic particles and organic particles having a particle diameter less than about 4.5 micrometers. These electrophotographic imaging members may have a flexible belt form or rigid drum configuration. The ability of hydrophobic silica to stabilize a dispersion containing polytetrafluoroethylene particles as in the present invention is not taught, nor is it taught to use the charge transport layer in an apparatus employing an AC bias charging roll.

Thus, it has been broadly known to attempt to utilize small particles such as polytetrafluoroethylene in outer layers of a photoreceptor in an effort to increase the hardness/durability of the outer photoreceptor layers. However, these particles have been difficult to disperse uniformly in the materials typically used for certain layers of the imaging member, particularly the charge transport layer. When a charge transport layer is formed from a dispersion in which such particles are poorly dispersed, the imaging member exhibits lesser electrical performance and poorer print quality. Poor dispersion causes high residual voltage (Vr) and Vr cycle-up, as well as leading to non-uniform coatings that contain large size particle aggregates (since poor dispersion prevents uniform aggregates from forming). The presence of large size aggregates lessens print quality as they cause white spots to occur in a solid image area. The large aggregates on the surface also cause difficulty in toner cleaning during the printing cycles. Poor cleaning can cause non-uniform density, such as streaks, to print-out. Poor cleaning also reduces toner transfer efficiency and increases toner waste.

Moreover, particles such as polytetrafluoroethylene slowly settle over time in a CTL coating dispersion as a result of the high density of the PTFE. Thus, it is necessary to frequently stir the dispersion in order to avoid settling of the PTFE particles. This is an impractical, expensive method for maintaining the uniformity of the dispersion over time, and renders storage and shipment of the dispersion difficult.

What is still desired, then, is a composition for a charge transport layer of an imaging member that forms an excellent, stable dispersion when particle additives, particularly polytetrafluoroethylene particles, are included in the composition.

SUMMARY OF THE INVENTION

It is therefore an object of the invention to develop a method of stabilizing a dispersion that contains polytetrafluoroethylene aggregates.

It is a still further object of the present invention to develop a charge transport layer of an imaging member which exhibits excellent electrical performance and delivers superior print quality.

It is a still further object of the present invention to develop a charge transport layer composition that possesses excellent wear resistance and durability, particularly when used in an imaging apparatus employing an AC bias charging roll.

These and other objects are obtained by the present invention. In a first aspect, the present invention relates to a process of stabilizing a charge transport layer material dispersion containing polytetrafluoroethylene particles, comprising adding an amount of hydrophobic silica to a mixture of at least a polycarbonate polymer binder, at least one charge transport material, polytetrafluoroethylene particles and at least one solvent to form a composition, and mixing the composition under high shear conditions to form the stabilized dispersion, wherein the polytetrafluoroethylene particles form polytetrafluoroethylene particle aggregates, uniformly dispersed throughout the material, having an average size of less than about 1.5 microns, during the mixing.

In a further aspect of the invention, the invention relates to a charge transport layer material for a photoreceptor comprising at least a polycarbonate polymer binder having a number average molecular weight of not less than 35,000, at least one charge transport material, polytetrafluoroethylene particle aggregates having an average size of less than about 1.5 microns, hydrophobic silica amorphous silica of diameter less than 100 nanometer and a fluorine-containing polymeric surfactant dispersed in a solvent mixture comprised of at least tetrahydrofuran and toluene.

In a still further aspect of the invention, the invention relates to an image forming device comprising at least a photoreceptor and an AC bias charging roll which contacts and charges the photoreceptor, wherein the photoreceptor comprises an optional anti-curl layer, a substrate, an optional hole blocking layer, an optional adhesive layer, a charge generating layer, a charge transport layer comprising a binder comprised of a polycarbonate polymer binder having a number average molecular weight of not less than 35,000, at least one charge transport material, polytetrafluoroethylene particle aggregates having an average size of less than about 1.5 microns uniformly dispersed throughout the binder, hydrophobic silica and a fluorine-containing polymeric surfactant, and an optional overcoat layer.

By the addition of a small amount of hydrophobic silica to a charge transport layer material dispersion containing polytetrafluoroethylene particles, the long term stability of the dispersion is surprisingly improved. The surprisingly stable and uniform dispersion can be formed into a charge transport layer, which enables a photoreceptor containing the charge transport layer to exhibit excellent wear resistance against contact with an AC bias charging roll, to exhibit excellent electrical performance and improved toner cleaning ability, and to deliver superior print quality.

DETAILED DESCRIPTION OF PREFERRED EMBODIMENTS

In the present invention, the charge transport layer material for a photoreceptor comprises at least a polycarbonate polymer binder, at least one charge transport material, polytetrafluoroethylene particle aggregates having an average size of less than about 1.5 microns and hydrophobic silica dispersed in at least one solvent.

The polycarbonate polymer binder preferably has a number average molecular weight of not less than 35,000, although lower weight polycarbonates may be used, if desired. Preferably, the polycarbonate polymer binder consists of a polycarbonate Z polymer (bisphenol Z type polycarbonate polymers). Most preferably, the polycarbonate Z polymer is, for example, a poly(4,4'-diphenyl-1,1'-cyclohexane carbonate) polymer. This type of polycarbonate resin is commercially available under the trade name "PCZ", for example PCZ-400 (having a number average molecular weight of about 39,000), from Mitsubishi Gas Chemical Company. This type of polycarbonate may have the following structure where n is appropriate for the above-mentioned weight average molecular weight ranges.

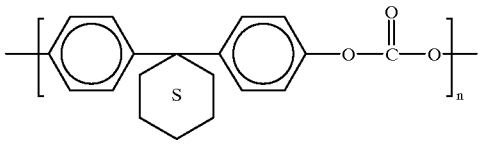

Although it has been difficult to form uniform and stable dispersions of PTFE particles with higher molecular weight polycarbonates, such is surprisingly achieved in the present invention through an overall selection of solids and solvents. Thus, in the present invention, the polycarbonate polymer binder most preferably has a number average molecular weight of at least about 35,000, and most preferably is a polycarbonate Z polymer as discussed above. Such a higher molecular weight polycarbonate binder contributes to the toughness and wear resistance of the charge transport layer herein.

The charge transport layer of a photoreceptor must be capable of supporting the injection of photo-generated holes and electrons from a charge generating layer and allowing the transport of all these holes or electrons through the organic layer to selectively discharge the surface charge. If some of the charges are trapped inside the transport layer, the surface charges will not completely discharge and the toner image will not be fully developed on the surface of the photoreceptor.

The charge transport layer thus must include at least one charge transport material. Any suitable charge transport molecule known in the art may be used, and the charge transport molecules may either be dispersed in the polymer binder or incorporated into the chain of the polymer. Suitable charge transport materials are very well known in the art, and thus are not described in detail herein.

Preferably, the charge transport material comprises an aromatic amine compound. More preferably, the charge transport layer comprises an arylamine small molecule dissolved or molecularly dispersed in the binder. Typical aromatic amine compounds include triphenyl amines, bis and poly triarylamines, bis arylamine ethers, bis alkylarylamines and the like. Most preferably, the charge transporting material is the aromatic amine TPD, which has the following formula:

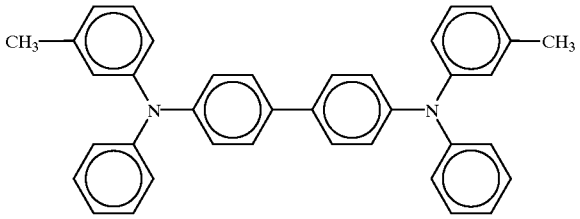

An especially preferred charge transport layer employed herein comprises from about 20 to about 80 percent by weight of at least one charge transport material and about 80 to about 20 percent by weight of the polymer binder. The dried charge transport layer preferably will contain between about 30 percent and about 70 percent by weight of a small molecule charge transport molecule based on the total weight of the dried charge transport layer.

To increase the wear resistance of the charge transport layer, polytetrafluoroethylene (PTFE) particles are included in the charge transport layer material. Any commercially available PTFE particle may be employed, including, for example, MP1100 and MP1500 from Dupont Chemical and L2 and L4, Luboron from Daikin Industry Ltd., Japan. The size of the PTFE particles are preferably less than 0.5 micron diameter, most preferably less than 0.3 micron. The surface of the PTFE particles is also preferably smooth to prevent air bubble generation during the dispersion preparation process. Air bubbles in the dispersion can cause coating defects on the surface which initiate toner cleaning failure.

The PTFE particles are preferably included in the composition in an amount of from, for example, about 0.1 to about 30 percent by weight, preferably about 2 to about 20 percent by weight, of the charge transport layer material.

Previously, it has been very difficult to maintain the stability of a charge transport layer material dispersion upon the incorporation of PTFE or other similar particles therein. As discussed above, the PTFE tends to settle over time in the dispersion due to its high density.

It has been surprisingly found that the dispersion of materials containing the PTFE particles can be stabilized against settling of the PTFE particles in the dispersion through addition of a small amount of neutral and hydrophobic silica to the dispersion. It has also been surprisingly found that the combination of PTFE and hydrophobic silica enhances toner cleaning. For example, hydrophobic silica in an amount of from about 0.1 to about 20 percent by weight of the overall composition, more preferably from about 1.0 to about 10 percent by weight of the overall composition, may be added to the composition in order to surprisingly stabilize the dispersion and improve toner cleaning.

Any hydrophobic amorphous silica may be used without restriction. However, it is preferred to use a hydrophobic amorphous silica having a small particle size, for example a hydrophobic silica having a diameter of less than about 500 nanometers, preferably less than about 100 nanometers, and most preferably having a diameter of from about 5 nanometers to about 50 nanometers. The surface of the silica particles is also preferably smooth to prevent air bubbles generation during the dispersion preparation process. Air bubbles in the dispersion can cause coating defects on the surface which initiate toner cleaning failure. A commercially available hydrophobic silica such as Aerosil R-104, R-504 and R-816 from Degussa Nippon Aerosil Co. may suitably be used.

In order for the silica added to not adversely affect the electrical performance of the charge transport layer, it is important that the silica be both hydrophobic and electrically neutral (i.e., not acidic or basic). Acidic silica may cause a lowering of the charging voltage of the photoreceptor and basic silica may cause high background voltage of the photoreceptor. Both cases may result in poor image quality. Use can be made of silicas that have been treated to be hydrophobic and/or neutral.

It is believed that addition of the silica may surprisingly stabilize the dispersion containing the PTFE in several ways. First, the hydrophobic silica may increase the solution viscosity of the dispersion, thus substantially slowing the settling of the PTFE from the dispersion. Second, the hydrophobic silica disperses very well in the composition, as well as in dried films of the charge transport layer. This permits the hydrophobic silica to space the PTFE particles in the dispersion and thereby prevent flocculation of the PTFE particles. Flocculation of PTFE particles in the dispersion is believed to lead to more rapid settling of the PTFE particles from the dispersion.

In addition, it has been found that if the PTFE particles are incorporated into the dispersion along with a surfactant, the PTFE particles aggregate into uniform aggregates during high shear mixing, and thus are more uniformly sized and dispersed throughout the dispersion. Preferably, the surfactant is a fluorine-containing polymeric surfactant. Most preferably, the fluorine-containing polymeric surfactant is a fluorine graft copolymer, for example GF-300 available from Daikin Industries. These types of fluorine-containing polymeric surfactants are described in U.S. Pat. No.5,637,142, incorporated herein by reference in its entirety.

The GF-300 (or other surfactant) level in the composition is important in maintaining the required dispersion quality and good electrical properties of the photoreceptor. Too much GF-300 may result in high residual voltage. Too little GF-300 may cause large aggregates of the PTFE particles.

The optimum amount of GF-300 in the dispersion depends on the amount of PTFE. As the PTFE amount is increased, the GF-300 amount should preferably be proportionally increased in order to maintain the PTFE dispersion quality. The preferred method is to maintain the surfactant (GF-300) to PTFE weight ratio between about 1 to about 4%. The most preferred ratio is between about 1.5 to about 3%.

The solvent system is a further critical component that assists in obtaining a stable dispersion of the foregoing components. Any solvent well known in the art, or mixtures of such solvents, may be used in forming the dispersion of the invention. Preferably, it has been found that the foregoing components can be stably and uniformly dispersed in a solvent system that comprises at least tetrahydrofuran (THF) and toluene. Other solvents may also be present, if desired. Most preferably, the weight ratio of tetrahydrofuran to toluene in the solvent system is from, for example, about 95:5 to about 50:50, more preferably from about 90:10 to about 60:40, and most preferably about 70:30. The total solid to total solvents should be about 15:85 wt % to about 30:70 wt %, preferably between about 20:80 wt % to about 25:75 wt %.

Additional conventional additives, such as antioxidants or leveling agents, may be included in the charge transport layer material as needed or desired.

To form the charge transport layer material of the present invention, the PTFE and surfactant components of the composition are first added to a vessel equipped with a stirrer. The components may be added to the vessel in any order without restriction, although the solvent system is most preferably added to the vessel first. Then the amorphous silica is mixed into the dispersion. The transport molecule and polycarbonate binder polymer are preferably dissolved separately, then combined with the solution containing the PTFE and surfactant.

The PTFE, silica and surfactant solution in the vessel may be stirred while the remaining transport molecule and binder polymer solution components are added to the vessel. Once all of the components of the charge transport layer material have been added to the vessel, mixing under high shear conditions is begun to form the dispersion. By "high shear" is meant stirring at a rate exceeding at least about 1,000 rpm. There are several different methods to apply high sheer to the dispersion. These include high shear mixing with a mixing stirrer, such as Silverson variable high shear Tissumizer Mark II (by Tekmar Company, ½ inch mix head with speeds of 8000, 9500, and 13,500 RPMs), with a homogenizer or a micro-fluidizer, or mill with an attritor or a dynomill with grinding mediums, such as glass beads or zirconium oxide beads, and with high frequency sonification. Stirring under these high shear conditions is continued for a sufficient time to form a stable dispersion, i.e., the dispersion is processed under high shear for an adequate amount of time until stable and uniform dispersion quality is formed.

During the formation of the dispersion under high shear conditions, the PTFE particles agglomerate. As a result of the selection of the components of the charge transport layer material and the solvents, the PTFE aggregates that form are uniformly dispersed throughout the material and are uniform in size. Typically, the PTFE aggregates have an average size of less than about 1.5 microns, more preferably about 1.0 microns or less.

The size of the aggregates may be determined by, for example, light scattering. A small amount of the dispersion is added into a solvent mixture in a cell used for light scattering measurement. The solvent mixture has the same composition as the one used for dispersion. The solution is then mixed with sonification a few minutes to let the dispersion uniformly mix into the solvents. The cell is then put into the light scattering instrument for measurement, such as BIC 90 plus particle size analyzer (by Brookhaven Instrument Corp.). Typically, the particle size is around 0.3 to 0.4 micron with half size around 0.2 micron. No particles larger than 1 micron are detected.

The charge transport layer coating solution of this invention has an excellent potlife on the order of, for example, at least 10 weeks at 25° C. In other words, the dispersion remains stable without settling of the PTFE particles therein for at least this amount of time. Within this period, there is no PTFE settling or solution separation detected. The size and size distribution of the aggregates remains unchanged within this period.

The charge transport layer dispersion is applied to the photoreceptor. More in particular, the layer is formed upon a previously formed charge generating layer. Any suitable and conventional technique may be utilized to mix and thereafter apply the charge transport layer coating solution to the charge generating layer. Typical application techniques include spraying, dip coating, roll coating, wire wound rod coating, draw bar coating and the like.

The dried charge transport layer has a thickness of between, for example, about 15 micrometers and about 45 micrometers. The coating quality of the charge transport layer from a good dispersion is very smooth. There is no visual particle protrusion on the coating surface. The surface smoothness is measured with a perfolometer. The measured Ra is between, for example, about 0.02 to about 0.08 micron.

The charge transport layer formed from the dispersion possesses a BCR wear rate of less than 6 microns per 100 kilocycles, which is about half that of conventional charge transport layers (which exhibit a BCR wear rate of 8 to 10 microns per 100 kilocycles). The life of a photoreceptor is considered to theoretically end when the charge transport layer is worn down to a thickness of 12 microns. As the thickness is worn down during operation (which occurs mainly as a result of BCR charging of the photoreceptor in combination with a wiper toner cleaning blade), the sensitivity of the photoreceptor decreases.

The other layers of the photoreceptor will next be explained. It should be emphasized that it is contemplated that the invention covers any photoreceptor structure so long as the charge transport layer has the composition described above. Any suitable multilayer photoreceptors may be employed in the imaging member of this invention. The charge generating layer and charge transport layer as well as the other layers may be applied in any suitable order to produce either positive or negative charging photoreceptors. For example, the charge generating layer may be applied prior to the charge transport layer, as illustrated in U.S. Pat. No. 4,265,990, or the charge transport layer may be applied prior to the charge generating layer, as illustrated in U.S. Pat. No. 4,346,158, the entire disclosures of these patents being incorporated herein by reference. Most preferably, however, the charge transport layer is employed upon a charge generating layer, and the charge transport layer may optionally be overcoated with an overcoat layer.

A photoreceptor of the invention employing the charge transport layer may comprise an optional anti-curl layer, a substrate, an optional hole blocking layer, an optional adhesive layer, a charge generating layer, the charge transport layer, and an optional overcoat layer.

The photoreceptor substrate may comprise any suitable organic or inorganic material known in the art. The substrate can be formulated entirely of an electrically conductive material, or it can be an insulating material having an electrically conductive surface. The substrate is of an effective thickness, generally up to about 100 mils, and preferably from about 1 to about 50 mils, although the thickness can be outside of this range. The thickness of the substrate layer depends on many factors, including economic and mechanical considerations. Thus, this layer may be of substantial thickness, for example over 100 mils, or of minimal thickness provided that there are no adverse effects on the system. Similarly, the substrate can be either rigid or flexible. In a particularly preferred embodiment, the thickness of this layer is from about 3 mils to about 10 mils. For flexible belt imaging members, preferred substrate thicknesses are from about 65 to about 150 microns, and more preferably from about 75 to about 100 microns for optimum flexibility and minimum stretch when cycled around small diameter rollers of, for example, 19 millimeter diameter.

The substrate can be opaque or substantially transparent and can comprise numerous suitable materials having the desired mechanical properties. The entire substrate can comprise the same material as that in the electrically conductive surface or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The conductive layer can vary in thickness over substantially wide ranges depending on the desired use of the electrophotoconductive member. Generally, the conductive layer ranges in thickness from about 50 Angstroms to many centimeters, although the thickness can be outside of this range. When a flexible electrophotographic imaging member is desired, the thickness of the conductive layer typically is from about 20 Angstroms to about 750 Angstroms, and preferably from about 100 to about 200 Angstroms for an optimum combination of electrical conductivity, flexibility, and light transmission. When the selected substrate comprises a nonconductive base and an electrically conductive layer coated thereon, the substrate can be of any other conventional material, including organic and inorganic materials. Typical substrate materials include insulating non-conducting materials such as various resins known for this purpose including polycarbonates, polyamides, polyurethanes, paper, glass, plastic, polyesters such as Mylar (available from Du Pont) or Melinex 447 (available from ICI Americas, Inc.), and the like. The conductive layer can be coated onto the base layer by any suitable coating technique, such as vacuum deposition or the like. If desired, the substrate can comprise a metallized plastic, such as titanized or aluminized Mylar, wherein the metallized surface is in contact with the photogenerating layer or any other layer situated between the substrate and the photogenerating layer. The coated or uncoated substrate can be flexible or rigid, and can have any number of configurations, such as a plate, a cylindrical drum, a scroll, an endless flexible belt, or the like. The outer surface of the substrate may comprise a metal oxide such as aluminum oxide, nickel oxide, titanium oxide, or the like.

Most preferably, the photoreceptor of the invention employing the charge transport layer is in the form of a drum, and most preferably in the form of a small diameter drum of the type used in copiers and printers.

A hole blocking layer may then optionally be applied to the substrate. Generally, electron blocking layers for positively charged photoreceptors allow the photogenerated holes in the charge generating layer at the top of the photoreceptor to migrate toward the charge (hole) transport layer below and reach the bottom conductive layer during the electrophotographic imaging processes. Thus, an electron blocking layer is normally not expected to block holes in positively charged photoreceptors such as photoreceptors coated with a charge generating layer over a charge (hole) transport layer. For negatively charged photoreceptors, any suitable hole blocking layer capable of forming an electronic barrier to holes between the adjacent photoconductive layer and the underlying zirconium or titanium layer may be utilized. A hole blocking layer may comprise any suitable material. Typical hole blocking layers utilized for the negatively charged photoreceptors may include, for example, polyamides such as Luckamide (a nylon-6 type material derived from methoxymethyl-substituted polyamide), hydroxy alkyl methacrylates, nylons, gelatin, hydroxyl alkyl cellulose, organopolyphosphazenes, organosilanes, organotitanates, organozirconates, silicon oxides, zirconium oxides, and the like. Preferably, the hole blocking layer comprises nitrogen containing siloxanes. Typical nitrogen containing siloxanes are prepared from coating solutions containing a hydrolyzed silane. Typical hydrolyzable silanes include 3-aminopropyl triethoxy silane, (N,N'-dimethyl 3-amino) propyl triethoxysilane, N,N-dimethylamino phenyl triethoxy silane, N-phenyl aminopropyl trimethoxy silane, trimethoxy silylpropyldiethylene triamine and mixtures thereof.

During hydrolysis of the amino silanes described above, the alkoxy groups are replaced with hydroxyl group. An especially preferred blocking layer comprises a reaction product between a hydrolyzed silane and the zirconium and/or titanium oxide layer which inherently forms on the surface of the metal layer when exposed to air after deposition. This combination reduces spots and provides electrical stability at low RH. The imaging member is prepared by depositing on the zirconium and/or titanium oxide layer of a coating of an aqueous solution of the hydrolyzed silane at a pH between about 4 and about 10, drying the reaction product layer to form a siloxane film and applying electrically operative layers, such as a photogenerator layer and a hole transport layer, to the siloxane film.

The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. This siloxane coating is described in U.S. Pat. No. 4,464,450, the disclosure thereof being incorporated herein in its entirety. After drying, the siloxane reaction product film formed from the hydrolyzed silane contains larger molecules. The reaction product of the hydrolyzed silane may be linear, partially crosslinked, a dimer, a trimer, and the like.

The siloxane blocking layer should be continuous and have a thickness of less than about 0.5 micrometer because greater thicknesses may lead to undesirably high residual voltage. A blocking layer of between about 0.005 micrometer and about 0.3 micrometer (50 Angstroms to 3,000 Angstroms) is preferred because charge neutralization after the exposure step is facilitated and optimum electrical performance is achieved. A thickness of between about 0.03 micrometer and about 0.06 micrometer is preferred for zirconium and/or titanium oxide layers for optimum electrical behavior and reduced charge deficient spot occurrence and growth.

An adhesive layer may optionally be applied to the hole blocking layer. The adhesive layer may comprise any suitable film forming polymer. Typical adhesive layer materials include, for example, copolyester resins, polyarylates, polyurethanes, blends of resins, and like.

A preferred copolyester resin is a linear saturated copolyester reaction product of four diacids and ethylene glycol. The molecular structure of this linear saturated copolyester in which the mole ratio of diacid to ethylene glycol in the copolyester is 1:1. The diacids are terephthalic acid, isophthalic acid, adipic acid and azelaic acid. The mole ratio of terephthalic acid to isophthalic acid to adipic acid to azelaic acid is 4:4:1:1. A representative linear saturated copolyester adhesion promoter of this structure is commercially available as Mor-Ester 49,000 (available from Morton International Inc., previously available from duPont de Nemours & Co.). The Mor-Ester 49,000 is a linear saturated copolyester which consists of alternating monomer units of ethylene glycol and four randomly sequenced diacids in the above indicated ratio and has a weight average molecular weight of about 70,000. This linear saturated copolyester has a Tg of about 32° C. Another preferred representative polyester resin is a copolyester resin derived from a diacid selected from the group consisting of terephthalic acid, isophthalic acid, and mixtures thereof and diol selected from the group consisting of ethylene glycol, 2,2-dimethyl propanediol and mixtures thereof; the ratio of diacid to diol being 1:1, where the $T_g$ of the copolyester resin is between about 50° C. and about 80° C. Typical polyester resins are commercially available and include, for example, Vitel PE-100, Vitel PE-200, Vitel PE-200D, and Vitel PE-222, all available from Goodyear Tire and Rubber Co. More specifically, Vitel PE-100 polyester resin is a linear saturated copolyester of two diacids and ethylene glycol where the ratio of diacid to ethylene glycol in this copolyester is 1:1. The diacids are terephthalic acid and isophthalic acid. The ratio of terephthalic acid to isophthalic acid is 3:2. The Vitel PE-100 linear saturated copolyester consists of alternating monomer units of ethylene glycol and two randomly sequenced diacids in the above indicated ratio and has a weight average molecular weight of about 50,000 and a $T_g$ of about 71° C.

Another polyester resin is Vitel PE-200 available from Goodyear Tire & Rubber Co. This polyester resin is a linear saturated copolyester of two diacids and two diols where the ratio of diacid to diol in the copolyester is 1:1. The diacids are terephthalic acid and isophthalic acid. The ratio of terephthalic acid to isophthalic acid is 1.2:1. The two diols are ethylene glycol and 2,2-dimethyl propane diol. The ratio of ethylene glycol to dimethyl propane diol is 1.33:1. The Goodyear PE-200 linear saturated copolyester consists of randomly alternating monomer units of the two diacids and the two diols in the above indicated ratio and has a weight average molecular weight of about 45,000 and a $T_g$ of about 67° C.

The diacids from which the polyester resins of this invention are derived are terephthalic acid, isophthalic acid, adipic acid and/or azelaic acid acids only. Any suitable diol may be used to synthesize the polyester resins employed in the adhesive layer of this invention. Typical diols include, for example, ethylene glycol, 2,2-dimethyl propane diol, butane diol, pentane diol, hexane diol, and the like.

Alternatively, the adhesive interface layer may comprise polyarylate (ARDEL D-100, available from Amoco Performance Products, Inc.), polyurethane or a polymer blend of these polymers with a carbazole polymer. Adhesive layers are well known and described, for example in U.S. Pat. No. 5,571,649, U.S. Pat. No. 5,591,554, U.S. Pat. No. 5,576,130, U.S. Pat. No. 5,571,648, U.S. Pat. No. 5,571,647 and U.S. Pat. No. 5,643,702, the entire disclosures of these patents being incorporated herein by reference.

Any suitable solvent may be used to form an adhesive layer coating solution. Typical solvents include tetrahydrofuran, toluene, hexane, cyclohexane, cyclohexanone, methylene chloride, 1,1,2-trichloroethane, monochlorobenzene, and the like, and mixtures thereof Any suitable technique may be utilized to apply the adhesive layer coating. Typical coating techniques include extrusion coating, gravure coating, spray coating, wire wound bar coating, and the like. The adhesive layer is applied directly to the charge blocking layer. Thus, the adhesive layer of this invention is in direct contiguous contact with both the underlying charge blocking layer and the overlying charge generating layer to enhance adhesion bonding and to effect ground plane hole injection suppression. Drying of the deposited coating may be effected by any suitable conventional process such as oven drying, infra red radiation drying, air drying and the like. The adhesive layer should be continuous. Satisfactory results are achieved when the adhesive layer has a thickness between about 0.03 micrometer and about 2 micrometers after drying. Preferably, the dried thickness is between about 0.05 micrometer and about 1 micrometer. At thickness of less than about 0.03 micrometer, the adhesion between the charge generating layer and the blocking layer is poor and delamination can occur when the photoreceptor belt is transported over small diameter supports such as rollers and curved skid plates. When the thickness of the adhesive layer of this invention is greater than about 2 micrometers, excessive residual charge buildup is observed during extended cycling.

The photogenerating layer may comprise single or multiple layers comprising inorganic or organic compositions and the like. One example of a generator layer is described in U.S. Pat. No. 3,121,006, the disclosure of which is totally incorporated herein by reference, wherein finely divided particles of a photoconductive inorganic compound are dispersed in an electrically insulating organic resin binder. Multiphotogenerating layer compositions may be utilized where a photoconductive layer enhances or reduces the properties of the photogenerating layer.

The charge generating layer of the photoreceptor may comprise any suitable photoconductive particle dispersed in a film forming binder. Typical photoconductive particles include, for example, phthalocyanines such as metal free phthalocyanine, copper phthalocyanine, titanyl phthalocyanine, hydroxygallium phthalocyanine, vanadyl phthalocyanine and the like, perylenes such as benzimidazole perylene, trigonal selenium, quinacridones, substituted 2,4-diamino-triazines, polynuclear aromatic quinones, and the like. Especially preferred photoconductive particles include hydroxygallium phthalocyanine, chlorogallium phthalocyanine, benzimidazole perylene and trigonal selenium.

Examples of suitable binders for the photoconductive materials include thermoplastic and thermosetting resins such as polycarbonates, polyesters, including polyethylene terephthalate, polyurethanes, polystyrenes, polybutadienes, polysulfones, polyarylethers, polyarylsulfones, polyethersulfones, polycarbonates, polyethylenes, polypropylenes, polymethylpentenes, polyphenylene sulfides, polyvinyl acetates, polyvinylbutyrals, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchlorides, polyvinyl alcohols, poly-N-vinylpyrrolidinone)s, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and the like. These polymers may be block, random or alternating copolymers.

Most preferably, the charge generating layer comprises hydroxygallium phthalocyanine in a polystyrene, polyvinyl pyridine block copolymer binder.

When the photogenerating material is present in a binder material, the photogenerating composition or pigment may be present in the film forming polymer binder compositions in any suitable or desired amounts. For example, from about 10 percent by volume to about 60 percent by volume of the photogenerating pigment may be dispersed in about 40 percent by volume to about 90 percent by volume of the film forming polymer binder composition, and preferably from about 20 percent by volume to about 30 percent by volume of the photogenerating pigment may be dispersed in about 70 percent by volume to about 80 percent by volume of the film forming polymer binder composition. Typically, the photoconductive material is present in the photogenerating layer in an amount of from about 5 to about 80 percent by weight, and preferably from about 25 to about 75 percent by weight, and the binder is present in an amount of from about 20 to about 95 percent by weight, and preferably from about 25 to about 75 percent by weight, although the relative amounts can be outside these ranges.

The particle size of the photoconductive compositions and/or pigments preferably is less than the thickness of the deposited solidified layer, and more preferably is between about 0.01 micron and about 0.5 micron to facilitate better coating uniformity.

The photogenerating layer containing photoconductive compositions and the resinous binder material generally ranges in thickness from about 0.05 micron to about 10 microns or more, preferably being from about 0.1 micron to about 5 microns, and more preferably having a thickness of from about 0.3 micron to about 3 microns, although the thickness can be outside these ranges. The photogenerating layer thickness is related to the relative amounts of photogenerating compound and binder, with the photogenerating material often being present in amounts of from about 5 to about 100 percent by weight. Higher binder content compositions generally require thicker layers for photogeneration. Generally, it is desirable to provide this layer in a thickness sufficient to absorb about 90 percent or more of the incident radiation which is directed upon it in the imagewise or printing exposure step. The maximum thickness of this layer is dependent primarily upon factors such as mechanical considerations, the specific photogenerating compound selected, the thicknesses of the other layers, and whether a flexible photoconductive imaging member is desired.

The photogenerating layer can be applied to underlying layers by any desired or suitable method. Any suitable technique may be utilized to mix and thereafter apply the photogenerating layer coating mixture. Typical application techniques include spraying, dip coating, roll coating, wire wound rod coating, and the like. Drying of the deposited coating may be effected by any suitable technique, such as oven drying, infra red radiation drying, air drying and the like.

Any suitable solvent may be utilized to dissolve the film forming binder. Typical solvents include, for example, tetrahydrofuran, toluene, methylene chloride, monochlorobenzene and the like. Coating dispersions for charge generating layer may be formed by any suitable technique using, for example, attritors, ball mills, Dynomills, paint shakers, homogenizers, microfluidizers, and the like.

Optionally, an overcoat layer can also be utilized to improve resistance of the photoreceptor to abrasion. In some cases an anticurl back coating may be applied to the surface of the substrate opposite to that bearing the photoconductive layer to provide flatness and/or abrasion resistance where a web configuration photoreceptor is fabricated. These overcoating and anticurl back coating layers are well known in the art, and can comprise thermoplastic organic polymers or inorganic polymers that are electrically insulating or slightly semiconductive. Overcoatings are continuous and typically have a thickness of less than about 10 microns, although the thickness can be outside this range. The thickness of anticurl backing layers generally is sufficient to balance substantially the total forces of the layer or layers on the opposite side of the substrate layer. An example of an anticurl backing layer is described in U.S. Pat. No. 4,654,284, the disclosure of which is totally incorporated herein by reference. A thickness of from about 70 to about 160 microns is a typical range for flexible photoreceptors, although the thickness can be outside this range. An overcoat can have a thickness of at most 3 microns for insulating matrices and at most 6 microns for semi-conductive matrices. The use of such an overcoat can still further increase the wear life of the photoreceptor, the overcoat having a wear rate of 2 to 4 microns per 100 kilocycles, or wear lives of between 150 and 300 kilocycles.

The photoreceptor of the invention is utilized in an electrophotographic image forming device for use in an electrophotographic imaging process. As explained above, such image formation involves first uniformly electrostatically charging the photoreceptor, then exposing the charged photoreceptor to a pattern of activating electromagnetic radiation such as light, which selectively dissipates the charge in the illuminated areas of the photoreceptor while leaving behind an electrostatic latent image in the non-illuminated areas. This electrostatic latent image may then be developed to form a visible image by depositing finely divided electroscopic toner particles, for example from a developer composition, on the surface of the photoreceptor. The resulting visible toner image can be transferred to a suitable receiving member such as paper.

The photoreceptor of the present invention is most preferably charged with an AC bias charging roll (BCR) as known in the art. See, for example, U.S. Pat. No. 5,613,173, incorporated herein by reference in its entirety. Of course, charging may be effected by other well known methods in the art if desired, for example utilizing a corotron or scorotron charging device.

By the selection of specific materials for the charge transport layer material, a surprisingly stable and uniform dispersion can be formed, which enables a photoreceptor containing the charge transport layer to exhibit excellent wear resistance against contact with an AC bias charging roll, to exhibit excellent electrical performance (e.g., to have no or low Vr), and to deliver superior print quality (e.g., to avoid the occurrence of white spots in solid image areas).

The invention will now be described in detail with respect to specific examples thereof. All parts and percentages are by weight unless otherwise indicated.

EXAMPLES 1 AND 2 AND COMPARATIVE EXAMPLES 1 AND 2

In these two examples and comparative examples, the photoreceptors have the same compositions except for the charge transport layer. In particular, the photoreceptors comprise a lathed aluminum substrate having coated thereon a blocking layer of 3 micron titanium dioxide dispersed in a phenolic resin, and a charge generating layer of chlorogallium phthalocyanine (ClGaPC) dispersed in VMCH binder (available from Union Carbide) at a ratio of ClGaPC:VMCH 54:36.

In Example 1, the charge transport layer molecule comprises TPD charge transport molecule and PCZ-400 polycarbonate Z polymer binder (weight ratio of 40:60) doped with 10% by weight PTFE particles (L2 from Daikin Industry, Ltd), 6% by weight hydrophobic silica (R-104, from Degussa) and 0.1% by weight GF-300 surfactant, dispersed in a solvent system of THF and toluene (weight ratio of 80:20).

In Example 2, the charge transport layer comprises the same components as in Example 1, in the same amounts, with the exception that the R-104 doping level is 10% by weight.

In Comparative Example 1, the charge transport layer material comprises the same components as in Example 1, in the same amounts, with the exception that no hydrophobic silica is included in the composition.

In Comparative Example 2, the charge transport layer comprises the same components as in Example 2, in the same amounts, with the exception that no PTFE is included in the composition.

The dispersion of the Comparative Example 1 shows some settling of the PTFE particles after 5 weeks, but the dispersion of Examples 1 and 2 (doped with hydrophobic silica) remain well dispersed after 10 weeks.

The photoreceptors of Examples 1 and 2 and Comparative Examples 1 and 2 are tested in a DC12 printer with spherical toner (5.5 micron diameter) and bias charge roll charging in the environment of 10° C. and 15% RH. The toner cleaning life is determined as the number of prints before streaks printed out on the prints. Example 1 shows cleaning life of 20,000 prints. Example 2 shows cleaning life of 12,000 prints. On the contrary, the cleaning life of Comparative Example 1 is 2,000 prints and the cleaning life of Comparative Example 2 is 6,000 prints.

Although the invention has been described with reference to specific preferred embodiments, it is not intended to be limited thereto. Rather, those having ordinary skill in the art will recognize that variations and modifications may be made therein which are within the spirit of the invention and within the scope of the claims.

What is claimed is:

1. A process of stabilizing a charge transport layer material dispersion containing polytetrafluoroethylene particles, comprising adding an amount of hydrophobic silica to a mixture of at least a polycarbonate polymer binder, at least one charge transport material, polytetrafluoroethylene particles, at least one fluorine-containing polymeric surfactant and at least one solvent to form a composition, and mixing the composition under high shear conditions to form the stabilized dispersion, wherein the polytetrafluoroethylene particles form polytetrafluoroethylene particle aggregates, uniformly dispersed throughout the material, having an average size of less than about 1.5 microns, during the mixing.

2. The process according to claim 1, wherein the mixing comprises stirring the material at a rate of at least about 1,000 rpm.

3. The process according to claim 1, wherein the dispersion contains from about 0.1 to about 30 percent by weight of the polytetrafluoroethylene particles and from about 0.1 to about 20 percent by weight of the hydrophobic silica.

4. The process according to claim 1, wherein the fluorine-containing polymeric surfactant is a fluorine graft copolymer.

5. The process according to claim 1, wherein the at least one solvent comprises a mixture of at least tetrahydrofuran and toluene, wherein the weight ratio of tetrahydrofuran to toluene is from about 95:5 to about 50:50.

6. A charge transport layer material for a photoreceptor comprising at least a polycarbonate polymer binder having a number average molecular weight of not less than 35,000, at least one charge transport material, polytetrafluoroethylene particle aggregates having an average size of less than about 1.5 microns, hydrophobic silica and a fluorine-containing polymeric surfactant dispersed in a solvent mixture comprised of at least tetrahydrofuran and toluene.

7. The charge transport layer material according to claim 6, wherein the polycarbonate polymer binder is a polycarbonate Z polymer.

8. The charge transport layer material according to claim 6, wherein the at least one charge transport material is TPD.

9. The charge transport layer material according to claim 6, wherein the fluorine-containing polymeric surfactant is a fluorine graft copolymer.

10. The charge transport layer material according to claim 6, wherein the material contains from about 0.1 to about 30 percent by weight of the polytetrafluoroethylene particle aggregates and from about 0.1 to about 20 percent by weight of the hydrophobic silica.

11. The charge transport layer material according to claim 6, wherein the material contains from about 0.01 to about 3 percent by weight of the fluorine-containing polymeric surfactant, wherein the weight ratio of the at least one charge transport material to the polycarbonate polymer binder is from about 20:80 to about 80:20, and wherein the weight ratio of tetrahydrofuran to toluene is from about 95:5 to about 50:50.

12. An image forming device comprising at least a photoreceptor and an AC bias charging roll which contacts and charges the photoreceptor, wherein the photoreceptor comprises an optional anti-curl layer, a substrate, an optional hole blocking layer, an optional adhesive layer, a charge generating layer, a charge transport layer comprising a binder comprised of a polycarbonate polymer binder having a number average molecular weight of not less than 35,000, at least one charge transport material, polytetrafluoroethylene particle aggregates having an average size of less than about 1.5 microns uniformly dispersed throughout the binder, hydrophobic silica and a fluorine-containing polymeric surfactant, and an optional overcoat layer.

13. The image forming device according to claim 12, wherein the polycarbonate polymer binder is a polycarbonate Z polymer.

14. The image forming device according to claim 12, wherein the at least one charge transport material is TPD.

15. The image forming device according to claim 12, wherein the fluorine-containing polymeric surfactant is a fluorine graft copolymer.

16. The image forming device according to claim 12, wherein the material contains from about 0.1 to about 30 percent by weight of the polytetrafluoroethylene particle aggregates and from about 0.1 to about 20 percent by weight of the hydrophobic silica.

17. The image forming device according to claim 12, wherein the material contains from about 0.01 to about 3 percent by weight of the fluorine-containing polymeric surfactant, wherein the weight ratio of the at least one charge transport material to the polycarbonate polymer binder is from about 20:80 to about 80:20, and wherein the weight ratio of tetrahydrofuran to toluene is from about 95:5 to about 50:50.

18. The image forming device according to claim 12, wherein the photoreceptor has a form of a drum.

19. The image forming device according to claim 12, wherein the charge transport layer has a bias charging roll wear rate of less than 6 microns per 100 kilocycles.

* * * * *